US008844920B1

(12) United States Patent
Dunham et al.

(10) Patent No.: US 8,844,920 B1
(45) Date of Patent: Sep. 30, 2014

(54) STAPLER PRODUCING HIGH PRECISION ALIGNMENT STACKING OF UNSTAPLED SHEETS

(71) Applicant: Xerox Corporation, Norwalk, CT (US)

(72) Inventors: Brian J. Dunham, Webster, NY (US); Carlos M. Terrero, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/917,856

(22) Filed: Jun. 14, 2013

(51) Int. Cl.
*B65H 37/04* (2006.01)
*B42C 1/12* (2006.01)

(52) U.S. Cl.
CPC ..... *B42C 1/12* (2013.01)
USPC ..... 270/58.09; 270/58.08; 270/58.11; 399/410

(58) Field of Classification Search
CPC ..... B65H 37/04
USPC ..... 270/58.08, 58.09, 58.11; 399/410
See application file for complete search history.

(56) References Cited

U.S. PATENT DOCUMENTS

| | | | | |
|---|---|---|---|---|
| 5,098,074 | A | 3/1992 | Mandel et al. | |
| 5,346,203 | A | 9/1994 | Stemmle | |
| 5,377,965 | A | 1/1995 | Mandel et al. | |
| 5,530,235 | A | 6/1996 | Stefik et al. | |
| 5,551,681 | A | 9/1996 | Ferrara | |
| 5,642,876 | A | 7/1997 | Ferrara et al. | |
| 6,032,004 | A | 2/2000 | Mirabella, Jr. et al. | |
| 6,260,837 | B1 * | 7/2001 | Nanba et al. | 270/58.08 |
| 6,283,354 | B1 * | 9/2001 | Hirota et al. | 227/39 |
| 6,443,450 | B1 | 9/2002 | Antinora | |
| 6,695,300 | B2 * | 2/2004 | Saito | 270/58.14 |
| 6,981,697 | B2 * | 1/2006 | Sasa et al. | 270/58.11 |
| 7,133,640 | B2 | 11/2006 | Zeller et al. | |
| 7,467,789 | B2 * | 12/2008 | Murata et al. | 270/58.12 |
| 7,627,282 | B2 * | 12/2009 | Oka et al. | 399/410 |
| 7,669,843 | B2 | 3/2010 | Milillo et al. | |
| 7,857,300 | B2 | 12/2010 | Moore et al. | |
| 7,871,066 | B2 * | 1/2011 | Kodama et al. | 270/58.12 |
| 7,918,450 | B2 * | 4/2011 | Yoshida | 271/207 |
| 7,922,164 | B2 * | 4/2011 | Nakayama | 270/58.12 |
| 7,976,004 | B2 * | 7/2011 | Kimura | 270/58.11 |
| 7,992,855 | B2 * | 8/2011 | Awano | 270/58.08 |
| 7,992,856 | B2 * | 8/2011 | Saito | 270/58.11 |
| 8,002,401 | B2 * | 8/2011 | Moriyama et al. | 347/104 |
| 2010/0008708 | A1 | 1/2010 | Czebiniak et al. | |

FOREIGN PATENT DOCUMENTS

| | | |
|---|---|---|
| EP | 0673868 A3 | 2/1996 |

* cited by examiner

*Primary Examiner* — Patrick Mackey
(74) *Attorney, Agent, or Firm* — Gibb & Riley, LLC

(57) ABSTRACT

During stapling operations: connectors disconnect a compiler platform from an elevator platform; an ejector structure is maintained in a fully retracted position to allow a stack of sheets to be within a stapling area; a stapling device staples the stack of sheets in the stapling area; the ejector structure moves the stapled set of sheets to the elevator platform; and the elevator platform moves in a downward direction after the ejector structure moves the stapled set of sheets to the elevator platform. During non-stapling stacking operations: the connectors connect the compiler platform to the elevator platform; the ejector structure is maintained in a middle position between a fully retracted position and a fully ejected position to prevent the sheets from entering the stapling area; and the elevator platform and the compiler platform move together in the downward direction as additional sheets are added to the stack of sheets.

24 Claims, 8 Drawing Sheets

STAPLER PRODUCING HIGH PRECISION ALIGNMENT STACKING OF UNSTAPLED SHEETS

BACKGROUND

Systems and methods herein generally relate to sheet handling devices, such as printing devices and finishing devices, and more particularly to devices that stack and staple sheets of media.

Printing devices and other devices that handle print media (including paper, transparencies, cardstock, plastics, etc.) often include finishing devices, such as staplers and stacking devices. In stapling devices, sheets are first compiled in the stapler throat prior to ejecting on to the elevator platform. Since the sheets are placed on the elevator platform in "chunks" a visible distinction between compiled sets is seen on the stack, which is undesirable.

Production stapling and precision stacking is not offered in a single finishing device, and therefore multiple finishers are needed to perform both stapling and precision stacking. This increases the number of activities in the workflow causing the user to select multiple finishing units, which is more cumbersome and more time intensive than having to select a single finishing unit.

SUMMARY

Exemplary devices herein include an elevator platform positioned adjacent a sheet output device to receive sheets traveling in a processing direction from the sheet output device. A compiler platform is positioned adjacent the elevator platform to receive a portion of each of the sheets traveling in the processing direction from the elevator platform. Thus, the elevator platform is positioned between the sheet output device and the compiler platform along the processing direction. Connectors selectively connect the compiler platform to the elevator platform.

Sheet tamper devices are positioned adjacent the compiler platform. The sheet tamper devices move in cross-process directions perpendicular to the processing direction across outer portions of the compiler platform to align the sheets positioned on the compiler platform into stacks of sheets. At least one stapling device is positioned adjacent the compiler platform. Thus, the compiler platform is positioned between the elevator platform and the stapling device along the processing direction.

An ejector structure is positioned adjacent the compiler platform. The ejector structure is movable across the compiler platform between the elevator platform and the stapling device in the processing direction and in an ejection direction that is opposite the processing direction. The ejector structure is movable to a fully retracted position adjacent the stapling device to allow the stack of sheets to be within a stapling area of the stapling device. The stapling device staples the stack of sheets when they are positioned in the stapling area (and while such sheets are also partially on the elevator platform and partially on the compiler platform). The ejector structure is also movable to a fully ejected position adjacent the elevator platform to move sheets from the stapling area onto the elevator platform.

A sheet feeder is positioned adjacent the compiler platform above the ejector structure. The sheet feeder contacts the sheets when the sheets are positioned on the compiler platform, and the sheet feeder moves the sheets in the processing direction toward the ejector structure. At least one controller is operatively connected to at least the elevator platform, the compiler platform, the connectors, the sheet tamper devices, the stapling device, the ejector structure, and the sheet feeder.

During stapling operations the controller causes the connectors to disconnect the compiler platform from the elevator platform, and causes the ejector structure to be maintained in the fully retracted position to allow the stack of sheets to be moved to the stapling area by the sheet feeder. The controller causes the sheet feeder to move the sheets in the processing direction to contact the ejector structure to align one edge of the sheets against the ejector structure (and move the sheets into the stapling area) during the stapling operations.

Also, during stapling operations, the controller causes the sheet tamper devices to align the stack of sheets while they are in the stapling area (and such sheets are also partially on the compiler and elevator platforms during this alignment process). Further, the controller causes the stapling device to staple the stack of sheets while they are in the stapling area to produce a stapled set of sheets. The controller then causes the ejector structure to move in the ejection direction to the fully ejected position to move the stapled set of sheets from the compiler platform to the elevator platform. After or while the ejector structure is moving the stapled set of sheets to the elevator platform, the controller causes the elevator platform to move in a downward direction that is perpendicular to the processing direction and that is in a direction away from the sheet output device and the ejector structure. The elevator platform moves downward an amount equal to the height of the stapled set of sheets after the ejector structure moves the stapled set of sheets to the elevator platform.

During non-stapling stacking operations, the controller causes the connectors to connect the compiler platform to the elevator platform, and causes the ejector structure to be maintained in a middle position (the middle position is somewhere between the fully retracted position and the fully ejected position) to prevent the sheets from entering the stapling area. However, when the ejector structure is maintained in the middle position, the sheets can still contact the sheet feeder and, therefore, the sheet feeder moves the sheets in the processing direction to contact the ejector structure to align one edge of the sheets against the ejector structure during the non-stapling stacking operations. The controller causes the sheet tamper devices to align the stack of sheets on the compiler platform (and such sheets are also partially on the elevator platform during this alignment process). The controller also causes the connected elevator and compiler platforms to move together in the downward direction as additional sheets are added to the stack of sheets. The elevator platform and the compiler platform move together in the downward direction an amount equal to the height of one of the sheets as each of the sheets are added to the stack of sheets during the non-stapling stacking operations.

These and other features are described in, or are apparent from, the following detailed description.

BRIEF DESCRIPTION OF THE DRAWINGS

Various exemplary systems and methods are described in detail below, with reference to the attached drawing figures, in which.

DETAILED DESCRIPTION

As mentioned above, production stapling and precision stacking is not offered in a single finishing device, and therefore multiple finishers are needed to perform both stapling and precision stacking, which is inefficient. Therefore, the systems and methods herein provide a finisher that produces unstapled precise stacks that do not exhibit stack mis-registration, without disabling the ability to produce stapled sets. This is achieved with a compiler platform that serves as a compiler shelf for stapled sets and forms part of the elevator for unstapled set stacking.

Figure 1:
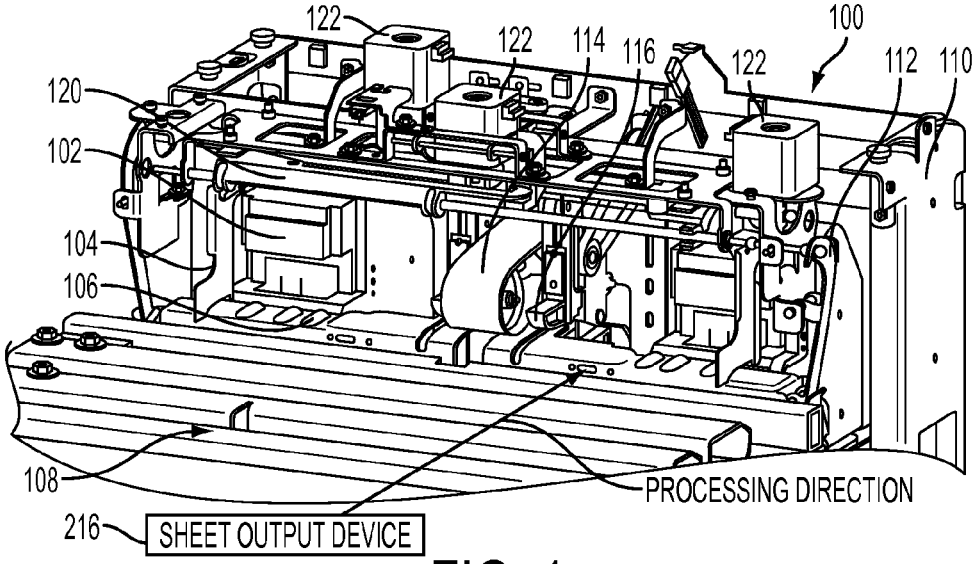
FIG. 1 is a schematic diagram illustrating stacking/stapling devices herein.
Figure 2:
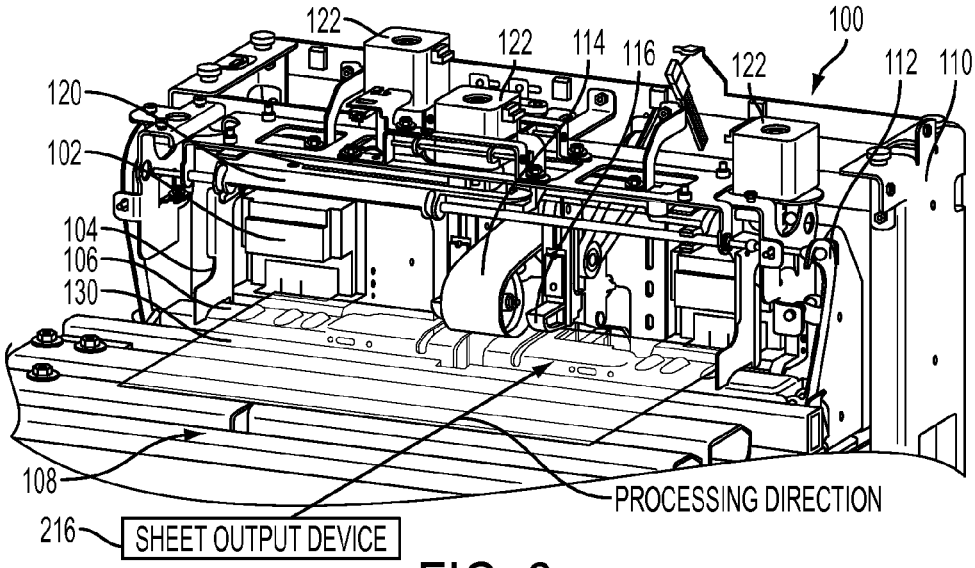
FIG. 2 is a schematic diagram illustrating stacking/stapling devices herein.

FIGS. 1-9 provide some non-limiting exemplary illustrations of apparatuses herein. The items defined in the claims are not limited to the examples shown in these figures, and those ordinarily skilled in the art would understand that these figures are merely used to illustrate one way in which the claimed structures could be implemented. More specifically, as shown in FIG. 1, item 100 generally illustrates a stapling and registration (precision alignment stacking) device that includes a frame 110 and various actuators and motors 120, 122.

These structures further include an elevator platform 108 positioned adjacent a generic "sheet output" device 216 (shown in FIGS. 11 and 12, discussed below) to receive sheets (one of which is shown as item 130 in FIG. 2) traveling in a processing direction from the sheet output device 216. The elevator platform 108 can be a single monolithic planar structure, or can be a multi-part structure, as is illustrated. The processing direction is shown by a block arrow in the drawings, and is generally in the direction from the sheet output device 216 toward the stapling and registration device 100.

A compiler platform 106 is positioned adjacent the elevator platform 108 to receive a portion of each of the sheets 130 traveling in the processing direction from the elevator platform 108. The compiler platform 106 can be a single monolithic planar structure as is illustrated, or can be a multi-part structure. Thus, as shown in the drawings, the elevator platform 108 is positioned between the sheet output device 216 and the compiler platform 106 along the processing direction. As further shown in FIG. 1, a sheet feeder 114 is positioned adjacent the compiler platform 106 above the ejector structure 116. The sheet feeder can be a roller, belt, etc. The sheet feeder 114 contacts the sheets 130 when the sheets 130 are positioned on the compiler platform 106, and the sheet feeder 114 moves the sheets 130 in the processing direction toward the ejector structure 116.

Connectors 112 selectively connect the compiler platform 106 to the elevator platform 108. The connectors 112 are shown in greater detail in FIGS. 8 and 9 and are discussed further below. At least one stapling device 102 is positioned adjacent the compiler platform 106. In the example shown in the drawings, two stapling devices are utilized, a front stapler and a rear stapler. Thus, the compiler platform 106 is positioned between the elevator platform 108 and the stapling device 102 along the processing direction.

As also shown in FIG. 1, sheet tamper devices 104 are positioned adjacent the compiler platform 106. For example, the sheet tampering devices 104 can be elongated structures having flat surfaces that press against the side of stacks of sheets. Further, the tampering devices 104 can be centered over the distal ends of the compiler platform 106, causing all alignment to be centered on the compiler platform 106. As shown by the double headed arrow in FIG. 3, the sheet tamper devices 104 move in cross-process directions perpendicular to the processing direction across outer portions of the compiler platform 106 to align the sheets 130 positioned on the compiler platform 106 into stacks of sheets 132.

Figure 4:
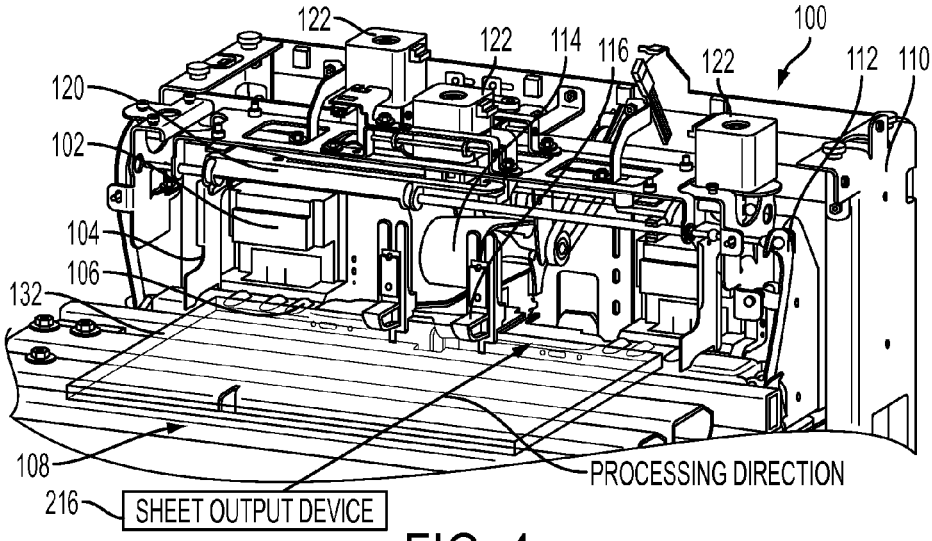
FIG. 4 is a schematic diagram illustrating stacking/stapling devices herein.

As additionally shown in FIG. 1, an ejector structure 116 is positioned adjacent the compiler platform 106. The ejector structure 116 can be a single monolithic structure or a multi-part structure and generally has at least one flat surface that presses against the stacks of sheets. As is understood by those ordinarily skilled in the art, the ejector structure 116 can include "skis" that press down on the top of the stack, and other features to help hold, align, and move the stack of sheets. This ejector structure 116 is sometimes referred to as a registration wall and set ejector. As shown in FIG. 4, the ejector structure 116 is movable across the compiler platform 106 between the elevator platform 108 and the stapling device 102 in the processing direction and in an ejection direction that is opposite the processing direction (using, for example, the motors/actuators 120, 122).

Figure 3:
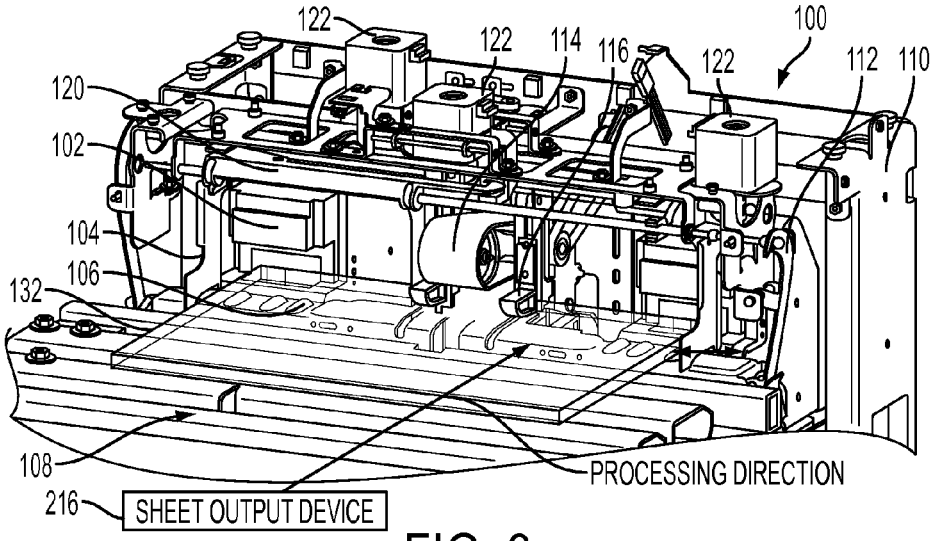
FIG. 3 is a schematic diagram illustrating stacking/stapling devices herein.

The ejector structure 116 is movable to a "fully retracted" position adjacent the stapling device 102 as shown in FIG. 3 to allow the stack of sheets 132 to be within a stapling area of the stapling device 102. As also shown in FIG. 3, the stapling device 102 staples the stack of sheets 132 when they are positioned in the stapling area (note that, as shown, such sheets can also partially be on the elevator platform 108 and partially on the compiler platform 106 during stapling). The ejector structure 116 is also movable to a "fully ejected" position adjacent the elevator platform 108 to move sheets from the stapling area onto the elevator platform 108, as shown in FIG. 4.

Figure 11:
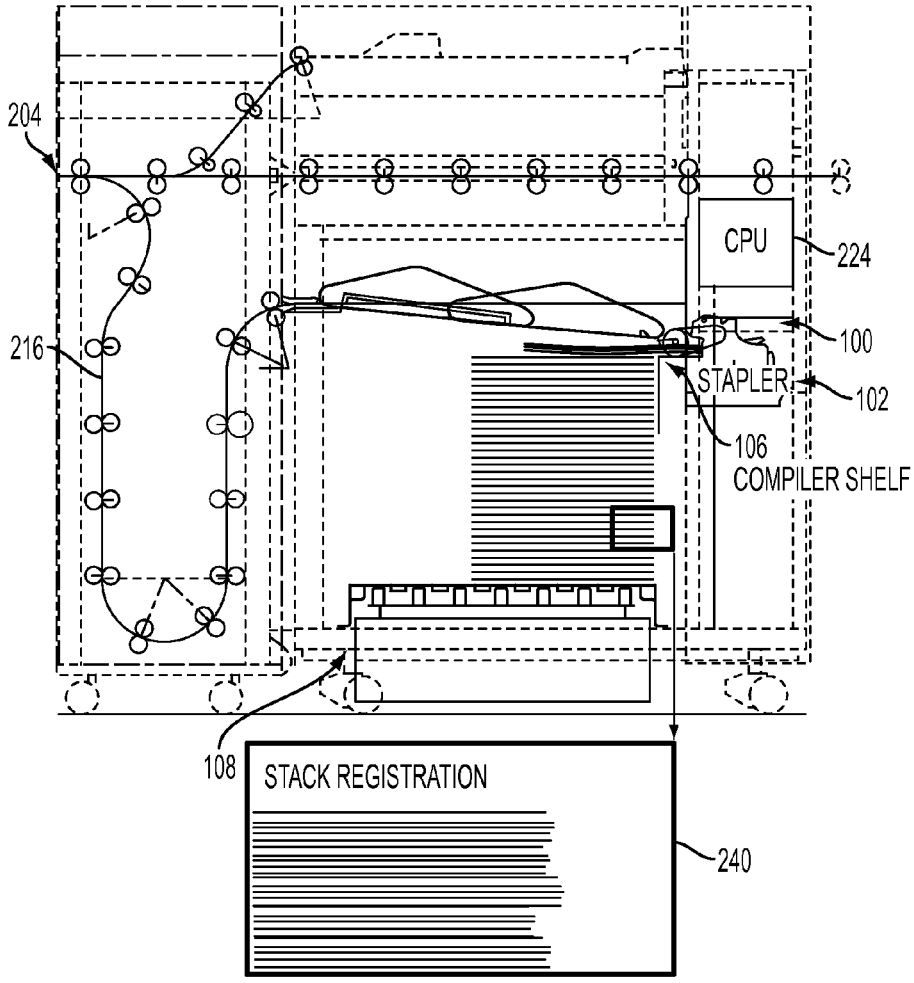
FIG. 11 is a schematic diagram illustrating printing devices herein.
Figure 12:
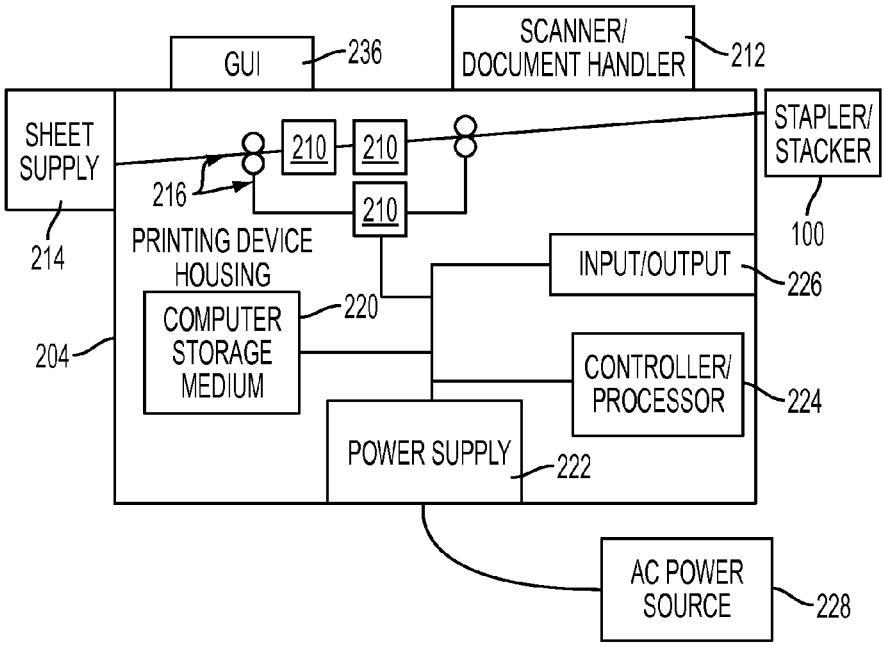
FIG. 12 is a schematic diagram illustrating printing devices herein.

As shown in FIGS. 11 and 12, discussed below, at least one controller 224 is operatively (meaning directly or indirectly) connected to all controllable elements within the stapling and alignment structure 100 including at least the elevator platform 108, the compiler platform 106, the connectors 112, the sheet tamper devices, the stapling device 102, the ejector structure 116, the sheet feeder 114, the motors/actuators 120, 122, etc.

As shown in FIG. 3, during stapling operations, the controller 224 causes the connectors 112 to disconnect the compiler platform 106 from the elevator platform 108 (using, for example, the motors/actuators 120, 122) and causes the ejector structure 116 to be maintained in the fully retracted position to allow the stack of sheets 132 to be moved to the stapling area by the sheet feeder 114. The controller 224 thus causes the sheet feeder 114 to move the sheets 130 in the processing direction to contact the ejector structure 116 to align one edge of the sheets 130 against the ejector structure 116 (and move the sheets 130 into the stapling area) during the stapling operations.

Also, during stapling operations shown in FIG. 3, the controller 224 causes the sheet tamper devices 104 to align the stack of sheets 132 while they are in the stapling area (note again that such sheets can also partially be on the compiler 106 and elevator platforms 108 during this alignment process). Further, the controller 224 causes the stapling device 102 to staple the stack of sheets 132 while they are in the stapling area to produce a stapled set of sheets 132. As mentioned above, the alignment can be centered on the compiler platform 106 because the tamper devices 104 can be aligned with (e.g., centered over) the distal ends of the compiler platform. Thus, keeping the compiler platform 106 connected to the stapling area ensures that sheets are precisely aligned in the stapler area.

Figure 5:
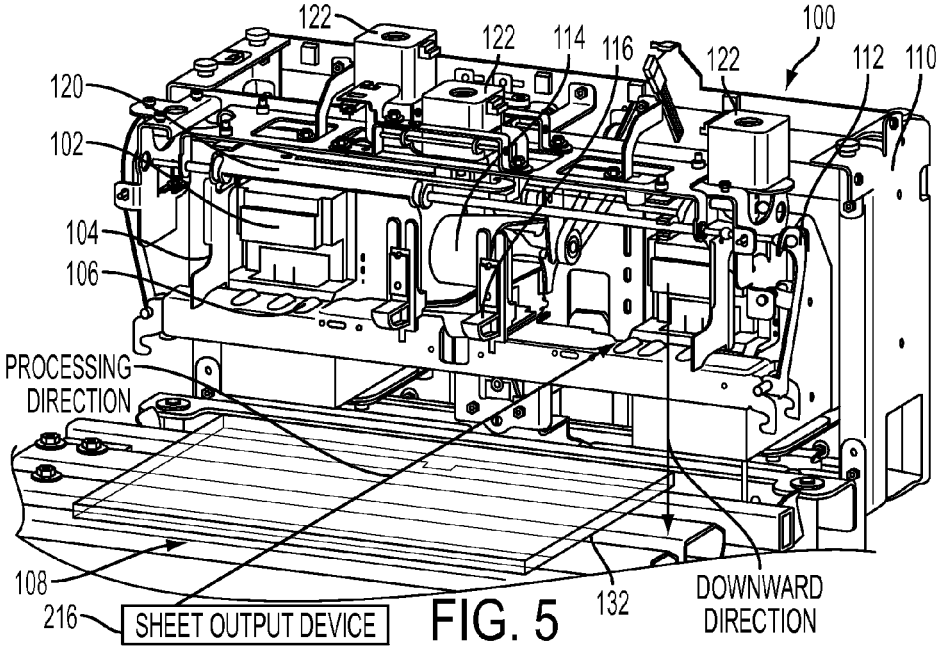
FIG. 5 is a schematic diagram illustrating stacking/stapling devices herein.

As shown in FIG. 4, the controller 224 then causes the ejector structure 116 to move in the ejection direction to the fully ejected position to move the stapled set of sheets 132 from the compiler platform 106 to the elevator platform 108. After or while the ejector structure 116 is moving the stapled set of sheets 132 to the elevator platform 108, the controller 224 causes the elevator platform 108 to move in a downward direction (using, for example, the motors/actuators 120, 122) as shown in FIG. 5. This downward or "first" direction is shown using an arrow in FIG. 5 and is perpendicular to the processing direction and the downward direction is a direction away from the sheet output device 216 and the ejector structure 116. The elevator platform 108 moves downward an amount equal to the height of the stapled set of sheets 132 after the ejector structure 116 moves the stapled set of sheets 132 to the elevator platform 108.

Thus, for staple jobs the compiler platform 106 serves as a compiler shelf as it does in standard staplers. Sets are compiled (FIG. 3) and then ejected (FIG. 4) onto the elevator platform 108. The set is ejected past the stapler and compiler shelf by the ejector structure 116. As the elevator platform 108 lowers, the compiler platform 106 remains a part of the stapling area (FIG. 5).

Figure 6:
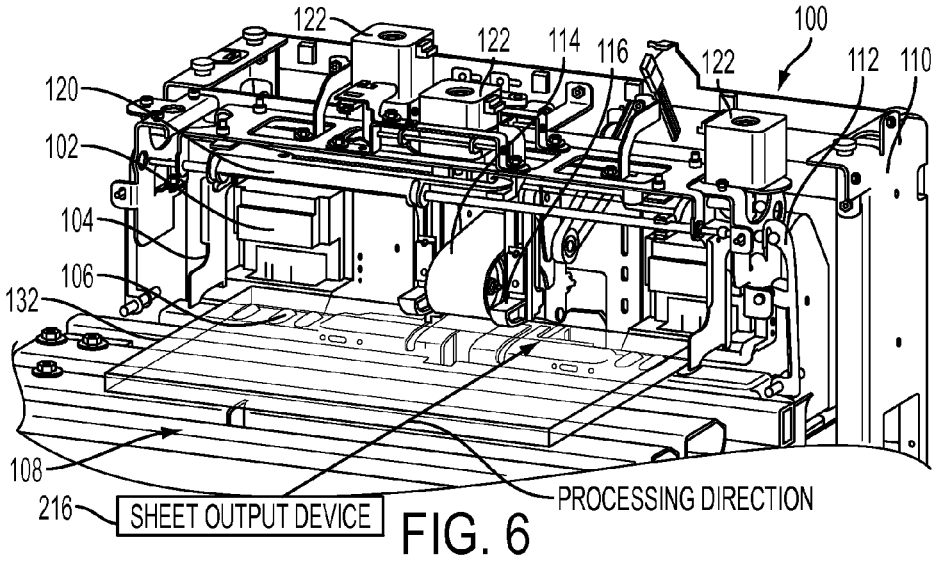
FIG. 6 is a schematic diagram illustrating stacking/stapling devices herein.

As shown in FIG. 6, during non-stapling stacking operations, the controller 224 causes the connectors 112 to connect the compiler platform 106 to the elevator platform 108 (using, for example, the motors/actuators 120, 122) and causes the ejector structure 116 to be maintained in a middle position (the middle position is somewhere between the fully retracted position and the fully ejected position) to prevent the sheets 130 from entering the stapling area.

However, when the ejector structure 116 is maintained in the middle position, the sheets 130 can still contact the sheet feeder 114 and, therefore, the sheet feeder 114 moves the sheets 130 in the processing direction to contact the ejector structure 116 to align one edge of the sheets 130 against the ejector structure 116 during the non-stapling stacking operations. Therefore this "middle" position of the ejector structure 116 is any location between the fully retracted position and the fully ejected position so long as the ejector structure 116 prevents the sheets 130 from entering the stapling area, yet still allows the sheets 130 to be in a position to be contacted by the sheet feeder 114. Further, this middle position causes at least a portion of the sheets to rest on the compiler platform.

The controller 224 causes the sheet tamper devices 104 to align the stack of sheets 132 on the compiler platform 106 (and, as shown, such sheets 132 are also partially on the elevator platform 108 during this alignment process). As mentioned above, the alignment can be centered on the compiler platform 106 because the tamper devices 104 can be aligned with the distal ends of the compiler platform, and keeping the compiler platform 106 connected to the elevator platform 108 ensures that sheets are precisely aligned when placed on the top of the stack of sheets being created on the elevator platform 108.

Figure 7:
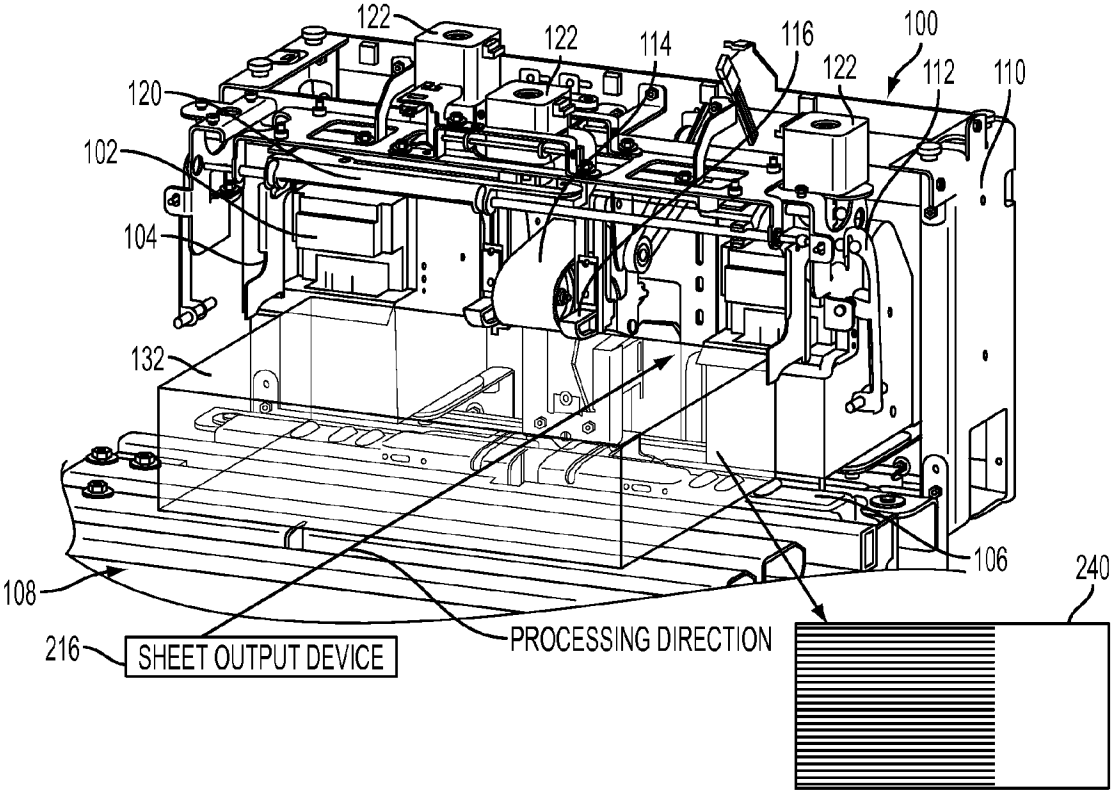
FIG. 7 is a schematic diagram illustrating stacking/stapling devices herein.

As shown in FIG. 7, the controller 224 also causes the connected elevator 108 and compiler 106 platforms to move together in the downward direction as additional sheets are added to the stack of sheets 132. The elevator platform 108 and the compiler platform 106 move together in the downward direction an amount equal to the height of one of the sheets 130 as each of the sheets 130 are added to the stack of sheets 132 during the non-stapling stacking operations. This allows each sheet to be at a height that it can be contacted by, and aligned by, the tamper devices 104 as it is added to the top of the stack of sheets. As also shown in FIG. 7 (and FIG. 11, discussed below) this produces a precisely aligned stack of unstable sheets 240.

Thus, for precision stacking of unstapled sets the ejector structure 116 moves to a position that will prevent the sheet from entering the stapler (FIG. 6). Placing the ejector structure 116 in the middle location allows continuous stacking. The connector 112 connects the compiler platform 106 to the elevator platform 108. The compiler platform 106 therefore now forms part of the elevator platform 108, and can lower as sheets are stacked directly on the top of the stack of sheets 132 (FIG. 7).

Figure 8:
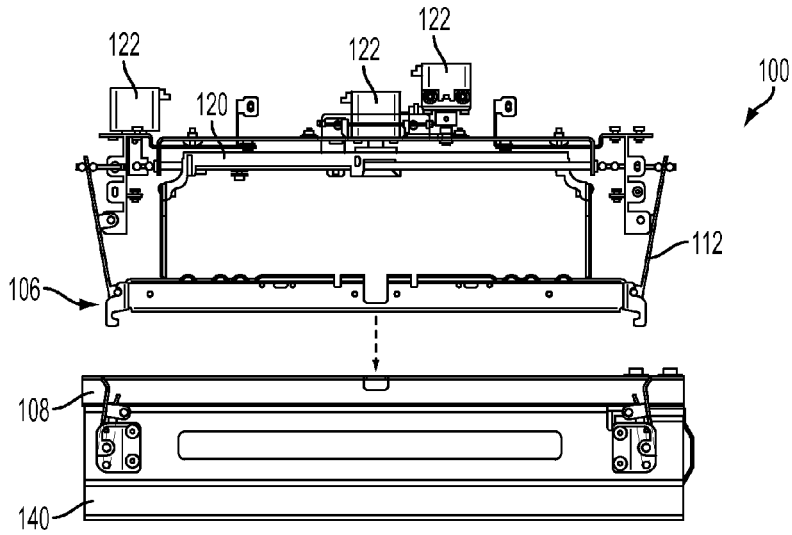
FIG. 8 is a schematic diagram illustrating stacking/stapling devices herein.
Figure 9:
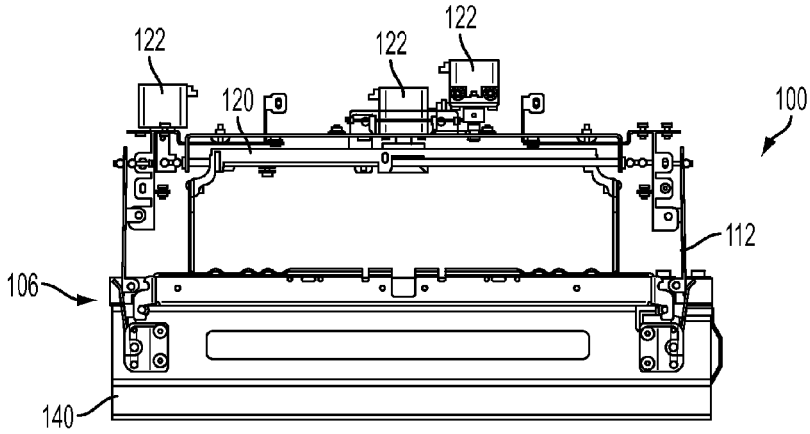
FIG. 9 is a schematic diagram illustrating stacking/stapling devices herein.

FIGS. 8 and 9 illustrate the operation of the connector 112 in greater detail. More specifically, as shown in FIG. 8, during the stapling operations, the compiler platform 106 is disconnected from the elevator platform 108. In FIG. 8, the connectors 112 move to disconnect latches (using, for example, the motors/actuators 120, 122) allowing the compiler platform 106 and the elevator platform 108 to move independently of one another. To the contrary, as shown in FIG. 9, the connectors 112 move to connect latches, requiring the compiler platform and the elevator platform 108 to move together (in the downward direction, or in an upward direction that is opposite the downward direction).

Figure 10:
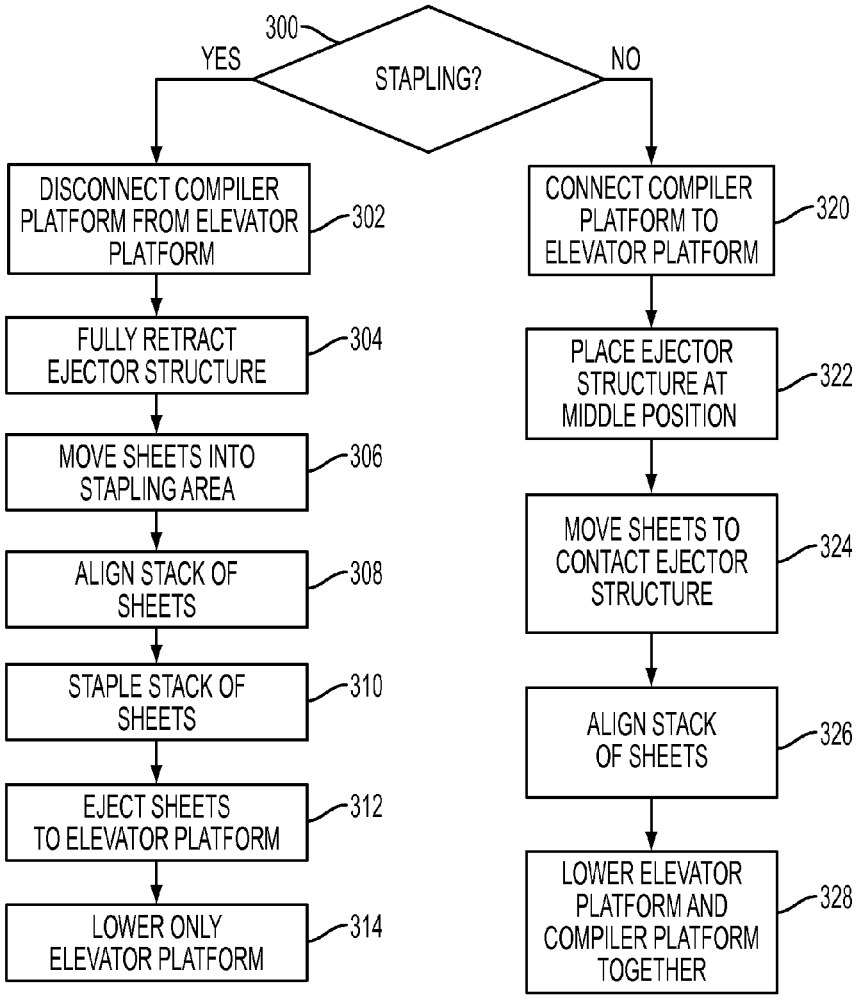
FIG. 10 is a flow diagram of various methods herein.

FIG. 10 is a flowchart illustrating operations of devices herein. All processing shown in FIG. 10 is fully automatic, and does not require user input or action. In item 300, processing begins by choosing whether stapling will be performed when a sheet is received from the sheet output device. If so, in item 302, during stapling operations, the controller causes the connectors to disconnect the compiler platform from the elevator platform, and causes the ejector structure to be maintained in the fully retracted position (item 304) to allow the stack of sheets to be moved to the stapling area by the sheet feeder. The controller causes the sheet feeder to move the sheets in the processing direction to contact the ejector structure to align one edge of the sheets against the ejector structure (and move the sheets into the stapling area, item 306) during the stapling operations.

Also, as shown in item 308, during stapling operations, the controller causes the sheet tamper devices to align the stack of sheets while they are in the stapling area (and such sheets are also partially on the compiler and elevator platforms during this alignment process). Further, the controller causes the stapling device to staple the stack of sheets while they are in the stapling area to produce a stapled set of sheets in item 310.

The controller then causes the ejector structure to move in the ejection direction to the fully ejected position to move the stapled set of sheets from the compiler platform to the elevator platform in item 312. After or while the ejector structure is moving the stapled set of sheets to the elevator platform, the controller causes only the elevator platform (and not the compiler platform) to move in the downward direction in item 314. In item 314, the elevator platform moves downward an amount equal to the height of the stapled set of sheets after the ejector structure moves the stapled set of sheets to the elevator platform.

During non-stapling stacking operations (if item 300 indicates no stapling, only stacking) the controller causes the connectors to connect the compiler platform to the elevator platform in item 320, and causes the ejector structure to be maintained in a middle position in item 322 (again, the middle position is somewhere between the fully retracted position and the fully ejected position) to prevent the sheets from entering the stapling area. However, when the ejector structure is maintained in the middle position, the sheets can still contact the sheet feeder and, therefore, the sheet feeder moves the sheets in the processing direction to contact the ejector structure (item 324) to align one edge of the sheets against the ejector structure during the non-stapling stacking operations.

In item 326, the controller causes the sheet tamper devices to align the stack of sheets on the compiler platform (and such sheets are also partially on the elevator platform during this alignment process). The controller also causes the connected elevator and compiler platforms to move together in the downward direction as additional sheets are added to the stack of sheets in item 328. The elevator platform and the compiler platform move together in the downward direction an amount equal to the height of one of the sheets as each of the sheets are added to the stack of sheets during the non-stapling stacking operations.

FIGS. 11 and 12 illustrate different views of a computerized device that can be a printing device 204, which can be used with systems and methods herein and can comprise, for example, a printer, copier, multi-function machine, multi-function device (MFD), etc. The printing device 204 includes a controller/processor 224 (sometimes referred to as a central processing unit (CPU)) and a communications port (input/output) 226 operatively connected to the processor 224 and to the computerized network 202 external to the computerized device 204. Also, the printing device 204 can include at least one accessory functional component, such as a graphic user interface assembly 236 that also operate on the power supplied from the external power source 228 (through the power supply 222).

The input/output device 226 is used for communications to and from the printing device 204. The processor 224 controls the various actions of the computerized device. A non-transitory computer storage medium device 220 (which can be optical, magnetic, capacitor based, etc.) is readable by the processor 224 and stores instructions that the processor 224 executes to allow the printing device to perform its various functions, such as those described herein. Thus, as shown in FIGS. 11 and 12, a body housing 204 has one or more functional components that operate on power supplied from the alternating current (AC) 228 by the power supply 222. The power supply 222 can comprise a power storage element (e.g., a battery) and connects to an external alternating current power source 228 and converts the external power into the type of power needed by the various components.

The printing device 204 includes at least one marking device (printing engines) 210 operatively connected to the processor 224, a media path 216 positioned to supply sheets of media from a sheet supply 214 to the marking device(s) 210, etc. Note that the media path 216 is generically referred to herein as a sheet output device; however, any of the other sheet processing devices mentioned herein (and any sheet handling device whether currently known or developed in the future capable of outputting sheets to be stapled and stacked) could be the sheet output device 216 discussed herein. After receiving various markings from the printing engine(s), the sheets of media are output to the stapler/stacker 100, discussed above, which can stack, staple, and even potentially fold, sort, etc., the various printed sheets. Also, the printing device 204 can include at least one accessory functional component (such as a scanner/document handler 212, etc.) that also operates on the power supplied from the external power source 228 (through the power supply 222).

Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the systems and methods described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The systems and methods herein can encompass systems and methods that print in color, monochrome, or handle color or monochrome image data. All foregoing systems and methods are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the systems and methods herein cannot be implied or imported from any above example as limitations to any particular order, number, position, size, shape, angle, color, or material.

What is claimed is:

1. An apparatus comprising:

an elevator platform positioned to receive sheets traveling in a processing direction from a sheet output device;

a compiler platform positioned adjacent said elevator platform;

connectors selectively connecting said compiler platform to said elevator platform;

a stapling device adjacent said compiler platform, said compiler platform being positioned between said elevator platform and said stapling device, said stapling device stapling a stack of sheets positioned on said compiler platform; and an ejector structure being movable across said compiler platform, during stapling operations:

said connectors disconnecting said compiler platform from said elevator platform;

said ejector structure being maintained in a fully retracted position to allow said stack of sheets to be within a stapling area;

said stapling device stapling said stack of sheets in said stapling area to produce a stapled set of sheets;

said ejector structure moving to a fully ejected position to move said stapled set of sheets from said compiler platform to said elevator platform; and said elevator platform moving in a first direction perpendicular to said processing direction and away from said sheet output device and said ejector structure after said ejector structure moves said stapled set of sheets to said elevator platform, and during non-stapling stacking operations:

said connectors connecting said compiler platform to said elevator platform;

said ejector structure being maintained in a middle position between said fully retracted position and said fully ejected position to prevent said sheets from entering said stapling area; and said elevator platform and said compiler platform moving together in said first direction as additional ones of said sheets are added to said stack of sheets.

2. The apparatus according to claim 1, further comprising a sheet feeder positioned adjacent said compiler platform, said sheet feeder contacting said sheets when said sheets are positioned on said compiler platform, said sheet feeder moving said sheets in said processing direction.

3. The apparatus according to claim 2, said ejector structure being maintained in said middle position allowing said sheets to contact said sheet feeder.

4. The apparatus according to claim 2, said sheet feeder moving said sheets to contact said ejector structure to align one edge of said sheets during said stapling operations, and said sheet feeder moving said sheets to contact said ejector structure to align one edge of said sheets during said non-stapling stacking operations.

5. The apparatus according to claim 1, said elevator platform moving in said first direction an amount equal to a height of said stapled set of sheets after said ejector structure moves said stapled set of sheets to said elevator platform.

6. The apparatus according to claim 1, said elevator platform and said compiler platform moving together in said first direction an amount equal to a height of one of said sheets as each of said sheets are added to said stack of sheets.

7. An apparatus comprising:

an elevator platform positioned to receive sheets traveling in a processing direction from a sheet output device;

a compiler platform positioned adjacent said elevator platform;

connectors selectively connecting said compiler platform to said elevator platform;

sheet tamper devices aligning said sheets positioned on said compiler platform into a stack of sheets;

a stapling device adjacent said compiler platform, said compiler platform being positioned between said elevator platform and said stapling device, said stapling device stapling said stack of sheets positioned on said compiler platform; and an ejector structure being movable across said compiler platform between said elevator platform and said stapling device in said processing direction and in an ejection direction opposite said processing direction, said ejector structure being movable to a fully retracted position adjacent said stapling device to allow said stack of sheets to be within a stapling area of said stapling device, said ejector structure being movable to a fully ejected position adjacent said elevator platform to move sheets from said stapling area onto said elevator platform, during stapling operations:

said connectors disconnecting said compiler platform from said elevator platform;

said ejector structure being maintained in said fully retracted position to allow said stack of sheets to be within said stapling area;

said sheet tamper devices aligning said stack of sheets in said stapling area;

said stapling device stapling said stack of sheets in said stapling area to produce a stapled set of sheets;

said ejector structure moving in said ejection direction to said fully ejected position to move said stapled set of sheets from said compiler platform to said elevator platform; and said elevator platform moving in a first direction perpendicular to said processing direction and away from said sheet output device and said ejector structure after said ejector structure moves said stapled set of sheets to said elevator platform, and during non-stapling stacking operations:

said connectors connecting said compiler platform to said elevator platform;

said ejector structure being maintained in a middle position between said fully retracted position and said fully ejected position to prevent said sheets from entering said stapling area;

said sheet tamper devices aligning said stack of sheets on said compiler platform; and said elevator platform and said compiler platform moving together in said first direction as additional ones of said sheets are added to said stack of sheets.

8. The apparatus according to claim 7, further comprising a sheet feeder positioned adjacent said compiler platform, said sheet feeder contacting said sheets when said sheets are positioned on said compiler platform, said sheet feeder moving said sheets in said processing direction.

9. The apparatus according to claim 8, said ejector structure being maintained in said middle position allowing said sheets to contact said sheet feeder.

10. The apparatus according to claim 8, said sheet feeder moving said sheets to contact said ejector structure to align one edge of said sheets during said stapling operations, and said sheet feeder moving said sheets to contact said ejector structure to align one edge of said sheets during said non-stapling stacking operations.

11. The apparatus according to claim 7, said elevator platform moving in said first direction an amount equal to a height of said stapled set of sheets after said ejector structure moves said stapled set of sheets to said elevator platform.

12. The apparatus according to claim 7, said elevator platform and said compiler platform moving together in said first direction an amount equal to a height of one of said sheets as each of said sheets are added to said stack of sheets.

13. An apparatus comprising:

an elevator platform positioned adjacent a sheet output device to receive sheets traveling in a processing direction from said sheet output device;

a compiler platform positioned adjacent said elevator platform to receive a portion of each of said sheets traveling in said processing direction from said elevator platform, said elevator platform being positioned between said sheet output device and said compiler platform along said processing direction;

connectors selectively connecting said compiler platform to said elevator platform;

sheet tamper devices positioned adjacent said compiler platform, said sheet tamper devices moving in cross-process directions perpendicular to said processing direction across portions of said compiler platform to align said sheets positioned on said compiler platform into a stack of sheets;

a stapling device positioned adjacent said compiler platform, said stapling device stapling said stack of sheets positioned partially on said elevator platform and partially on said compiler platform, said compiler platform being positioned between said elevator platform and said stapling device along said processing direction; and an ejector structure positioned adjacent said compiler platform, said ejector structure being movable across said compiler platform between said elevator platform and said stapling device in said processing direction and in an ejection direction opposite said processing direction, said ejector structure being movable to a fully retracted position adjacent said stapling device to allow said stack of sheets to be within a stapling area of said stapling device, said ejector structure being movable to a fully ejected position adjacent said elevator platform to move sheets from said stapling area onto said elevator platform, during stapling operations:

said connectors disconnecting said compiler platform from said elevator platform;

said ejector structure being maintained in said fully retracted position to allow said stack of sheets to be within said stapling area;

said sheet tamper devices aligning said stack of sheets in said stapling area;

said stapling device stapling said stack of sheets in said stapling area to produce a stapled set of sheets;

said ejector structure moving in said ejection direction to said fully ejected position to move said stapled set of sheets from said compiler platform to said elevator platform; and said elevator platform moving in a first direction perpendicular to said processing direction and away from said sheet output device and said ejector structure after said ejector structure moves said stapled set of sheets to said elevator platform, and during non-stapling stacking operations:

said connectors connecting said compiler platform to said elevator platform;

said ejector structure being maintained in a middle position between said fully retracted position and said fully ejected position to prevent said sheets from entering said stapling area;

said sheet tamper devices aligning said stack of sheets on said compiler platform; and said elevator platform and said compiler platform moving together in said first direction as additional ones of said sheets are added to said stack of sheets.

14. The apparatus according to claim 13, further comprising a sheet feeder positioned adjacent said compiler platform, said sheet feeder contacting said sheets when said sheets are positioned on said compiler platform, said sheet feeder moving said sheets in said processing direction.

15. The apparatus according to claim 14, said ejector structure being maintained in said middle position allowing said sheets to contact said sheet feeder.

16. The apparatus according to claim 14, said sheet feeder moving said sheets to contact said ejector structure to align one edge of said sheets during said stapling operations, and said sheet feeder moving said sheets to contact said ejector structure to align one edge of said sheets during said non-stapling stacking operations.

17. The apparatus according to claim 13, said elevator platform moving in said first direction an amount equal to a height of said stapled set of sheets after said ejector structure moves said stapled set of sheets to said elevator platform.

18. The apparatus according to claim 13, said elevator platform and said compiler platform moving together in said first direction an amount equal to a height of one of said sheets as each of said sheets are added to said stack of sheets.

19. An apparatus comprising:

an elevator platform positioned adjacent a sheet output device to receive sheets traveling in a processing direction from said sheet output device;

a compiler platform positioned adjacent said elevator platform to receive a portion of each of said sheets traveling in said processing direction from said elevator platform, said elevator platform being positioned between said sheet output device and said compiler platform along said processing direction;

connectors selectively connecting said compiler platform to said elevator platform;

sheet tamper devices positioned adjacent said compiler platform, said sheet tamper devices moving in cross-process directions perpendicular to said processing direction across portions of said compiler platform to align said sheets positioned on said compiler platform into a stack of sheets;

a stapling device positioned adjacent said compiler platform, said stapling device stapling said stack of sheets positioned partially on said elevator platform and partially on said compiler platform, said compiler platform being positioned between said elevator platform and said stapling device along said processing direction;

an ejector structure positioned adjacent said compiler platform, said ejector structure being movable across said compiler platform between said elevator platform and said stapling device in said processing direction and in an ejection direction opposite said processing direction; and a controller operatively connected to said elevator platform, said compiler platform, said connectors, said sheet tamper devices, said stapling device, and said ejector structure, said ejector structure being movable to a fully retracted position adjacent said stapling device to allow said stack of sheets to be within a stapling area of said stapling device, said ejector structure being movable to a fully ejected position adjacent said elevator platform to move sheets from said stapling area onto said elevator platform, during stapling operations, said controller causing:

said connectors to disconnect said compiler platform from said elevator platform;

said ejector structure to be maintained in said fully retracted position to allow said stack of sheets to be within said stapling area;

said sheet tamper devices to align said stack of sheets in said stapling area;

said stapling device to staple said stack of sheets in said stapling area to produce a stapled set of sheets;

said ejector structure to move in said ejection direction to said fully ejected position to move said stapled set of sheets from said compiler platform to said elevator platform; and said elevator platform to move in a first direction perpendicular to said processing direction and away from said sheet output device and said ejector structure after said ejector structure moves said stapled set of sheets to said elevator platform, and during non-stapling stacking operations, said controller causing:

said connectors to connect said compiler platform to said elevator platform;

said ejector structure to be maintained in a middle position between said fully retracted position and said fully ejected position to prevent said sheets from entering said stapling area;

said sheet tamper devices to align said stack of sheets on said compiler platform; and said elevator platform and said compiler platform to move together in said first direction as additional ones of said sheets are added to said stack of sheets.

20. The apparatus according to claim 19, further comprising a sheet feeder positioned adjacent said compiler platform, said sheet feeder contacting said sheets when said sheets are positioned on said compiler platform, said sheet feeder moving said sheets in said processing direction.

21. The apparatus according to claim 20, said ejector structure being maintained in said middle position allowing said sheets to contact said sheet feeder.

22. The apparatus according to claim 20, said sheet feeder moving said sheets to contact said ejector structure to align one edge of said sheets during said stapling operations, and said sheet feeder moving said sheets to contact said ejector structure to align one edge of said sheets during said non-stapling stacking operations.

23. The apparatus according to claim 19, said elevator platform moving in said first direction an amount equal to a height of said stapled set of sheets after said ejector structure moves said stapled set of sheets to said elevator platform.

24. The apparatus according to claim 19, said elevator platform and said compiler platform moving together in said first direction an amount equal to a height of one of said sheets as each of said sheets are added to said stack of sheets.

* * * * *